US005527038A

United States Patent [19]

Mabie

[11] Patent Number: 5,527,038

[45] Date of Patent: Jun. 18, 1996

[54] GOLF TEACHING AID

[76] Inventor: Andy Mabie, 101 Teak Drive, Fredericton, New Brunswick, Canada, E3A 2H9

[21] Appl. No.: 389,410

[22] Filed: Feb. 16, 1995

[51] Int. Cl.[6] ..... A63B 69/36

[52] U.S. Cl. ..... 473/232; 473/238; 473/256

[58] Field of Search ..... 273/170, 186.1, 273/187.4, 186.2, 187.6, 194 R, 163 R, 163 A, 80 B, 80 A, 77 R, 193 R, 193 A

[56] References Cited

U.S. PATENT DOCUMENTS

| | | | |
|---|---|---|---|
| 3,649,028 | 3/1972 | Worrell . | |
| 3,649,029 | 3/1972 | Worrell . | |
| 3,677,553 | 7/1972 | Moore . | |
| 3,753,564 | 8/1973 | Brandell . | |
| 3,820,795 | 7/1974 | Taylor . | |
| 3,993,314 | 11/1976 | Harrington et al. . | |
| 4,541,631 | 9/1985 | Sasse | 273/170 |
| 5,082,279 | 1/1992 | Hull et al. | 273/170 |
| 5,288,080 | 2/1994 | Tice . | |
| 5,297,796 | 3/1994 | Peterson . | |
| 5,316,300 | 5/1994 | Simmons | 273/80 B |
| 5,351,959 | 10/1994 | Duffy | 273/170 |

FOREIGN PATENT DOCUMENTS 2167966 6/1986 United Kingdom .

*Primary Examiner*—Steven Wong
*Attorney, Agent, or Firm*—Birch, Stewart, Kolasch & Birch

[57] ABSTRACT

A golf swing teaching aid golf club is provided herein. It includes a golf club which is simple in construction and is devoid of complicated mechanical, electrical or electronic gadgetry. The golf teaching aid includes a golf club having a grip portion and a head portion, and a hollow cylindrical transparent shaft interposed between the grip portion and the head portion. The hollow cylindrical portion contains a predetermined volume of colored flowable liquid of low viscosity. Such liquid is freely flowable, unimpeded, from one end of the hollow cylindrical transparent shaft portion adjacent the grip portion to the other end thereof adjacent the head portion to check the correctness of the swing of a golfer. Before the golf swing, the liquid adopts a position within the hollow cylindrical transparent shaft at selected marker lines. Under the influence of centrifugal force during the golf stroke, the liquid thereby adopts different locations within the hollow cylindrical transparent shaft during the golf swing, at selected marker lines, so as to provide the golfer with an easily visible indicator of the correct attitude of back swing, at golf ball impact and of followthrough.

4 Claims, 2 Drawing Sheets

GOLF TEACHING AID

BACKGROUND OF THE INVENTION

1. Field of the Invention

This invention relates to a golf teaching aid. Such golf teaching aid is intended more particularly for practice purposes and incorporates means for enabling the user, or a coach instructing the user, to check the correctness or otherwise of the user's swing.

2. Description of the Prior Art

The structure of a golf club is different, depending on whether it is to be used for competition or playing purposes, for training purposes, or as a teaching aid.

In standard competition golf clubs, a hollow space in the head is filled by means of a setting plastics material foam mass in order to damp the impact noise and/or reduce its frequency.

On the other hand, in the case of a golf club suitable particularly for training purposes, it is important to improve strength and accuracy. For this purpose the user desires a club which is adjustable in a simple mode and manner to his or her particular needs. These needs extend over a wide range and are influenced by personal factors, e.g., state of training, condition and motivation. The most important parameters which determine the character of a golf club are its weight and weight distribution, i.e., the position of its center of gravity. The center of gravity is the one producing the most significant degree of change by adjustment, since the position of the center of gravity is critical for the acceleration work to be exerted by the player and for the momentum of the strike.

Different methods are known for influencing these parameters. Thus, it is known to regulate the center of gravity of a golf club by filling, for example, with lead powder, a limited hollow space left in the plastics material filling of the head, this space being accessible from the base plate of the head by removal of a closure screw.

It is also known to vary the character of a golf club through the mounting of external weights. Such a method does not represent a satisfactory solution, since it is uneconomical. Apart from the fact that this method requires the keeping of a multiplicity of such weights or an integral multiple thereof, considerable attention has to be paid to the security of the fastening of the weights, which must be equal to the high impact and centrifugal forces encountered. If, in addition, the weight of the club is to be increased while maintaining the position of the center of gravity, then it is necessary to arrange equal weights on both sides of the center of gravity.

A golf club is now also known by way of U.S. Pat. No. 3,993,314 patented Nov. 23, 1976 by L. E. Harrington et al, to improve a golf club for playing purposes in order to transmit increased driving force through the club face by utilizing a shifting weight. A flow cavity was provided in a club head recess and only in a portion of the golf club shaft for shifting movement of a liquid weight, e.g., mercury. The cavity was streamlined or tear-shaped in order to ensure uniformity of flow. At the same time, the cavity was sealed at nominal atmospheric pressure. The thermal expansion of the liquid weight was retarded by the higher partial gas pressure. To ensure flow rather than bubbling, a vent channel was provided to equalize the pressure.

A golf club is also known, namely, U.S. Pat. No. 5,082,279 patented Jan. 21, 1992 by H. L. Hull, to improve a golf club for playing purposes which was substantially hollow and was partially filed with a viscous fluid or other flowable material, e.g., ball-bearings or sand for improved weight distribution. It had multiple compartments to capture and retain the weight in different sections to change the weight of the club at the golf head or handle. Such golf club allowed the user to adjust the distribution of the weight of the club handle and head due to the fact that the weight in the golf club handle and golf club head was adjustable. A flowable material e.g., a liquid (e.g., water or anti-freeze) or flowable material (e.g., ball bearings or sand) was captured in compartments in the handle and/or the golf club head.

A golf club is also known, from U.S. Pat. No. 5,316,300 patented May 31, 1994 by S. P. Simmons, to improve a golf club for playing purposes which had a hollow shaft in which a high viscosity fluid was selectively placed in a predetermined location to minimize deformation of the shaft under load and to control the natural vibration frequency of the shaft. This fluid was of a high viscosity and was spaced from the opposite ends of the shaft a predetermined distance. Such spacing determined the natural vibration frequency of the shaft. The high viscosity fluid did not flow readily and gave the shaft a solid characteristic. When the shaft was swung, distortion of its cross-section in the area of the fluid was lessened substantially, which minimized bending or twisting of the shaft, thereby increasing the accuracy of the stroke. In addition, the selective, but fixed, location of the fluid column along the length of the shaft was used to raise or lower the natural resonant frequency thereof.

Moreover, a golf club is now known which is suitable for both competition and training purposes, namely, U.K. Patent Application GB 2,167,966A published Jun. 11, 1986 by A. Varley to improve a golf club for playing purposes. The golf club had a hollow head with a socket having its bore communicating with the interior of the head. A hollow shaft was retained at one end portion thereof in the socket and was provided at the other end portion thereof with a removable closure and a grip. An openable closure device was arranged at one end portion of the shaft to block the interior passage of the shaft. For the purpose of adaptation to the individual needs of the user, the hollow shaft was at least partially filled with a flowable filling material. To achieve a re-disposition of the center of gravity of the club while its total weight remained constant, the filling material could be transferred and maintained in any desired quantity into a selected hollow space of a head of the club by way of an openable closure arranged in the shaft end portion held in a socket of the head.

On the other hand, in the case of a golf club for use as a training aid, it was thought to be necessary for the golfer, and/or his coach, to have a visual indication of the exact path or arc taken by the club head during the swing and thus to enable him to check whether the club head is being swung correctly, i.e., whether the club head moves through the correct arc. It was also thought to be necessary for the golfer, and/or his coach, to see the precise points along the arc of the swing at which the light comes on and goes off, thereby indicating not only whether the arc of the swing is correct but also whether the club head reaches its maximum speed during the correct period of the swing.

Some important parameters of the golf swing are: the angle of the club face at impact (open, square, or closed); the arcuate path of travel of the club during impact (inside-out, outside-in, or on-line); and the speed of the club at impact; the location of the impact on the club face (toward the heel or toe, or centered).

If these parameters are less than nominal during the golf swing, the ball may begin its flight in the wrong direction with a possible sidespin. For example, a "slice" may result from an open club face and/or an outside-in swing path. Any device which provides feedback about the above parameters would be presumed to be of benefit.

There have been previous attempts to help visualize the golf swing. One approach to solving such problem was taken by Eugene N. Worrell with U.S. Pat. Nos. 3,649,028 and 3,649,029 dated Mar. 14, 1972. The patentee applied luminescent colored stripes to the top of the club, running parallel to the path of the swing. If the stripes appeared blurred during the swing, they must have been overlapping due to a club face angle error. The user would have to strain to get feedbacks, not to mention the problems of using an ultraviolet light and gauze-like material impregnated with luminescent chemical.

Another solution to providing such desirable feature was said to be provided in U.S. Pat. No. 3,677,553 patented Jul. 18, 1972 by E. Moore. In that patent, the shaft of a golf club included means actuated under the action of centrifugal force, during swinging of the club, to close contacts to complete an electric circuit containing a lamp mounted in the head of the club. Such structure consisted of a spring supported weight, preferably a dry battery, in the shaft of a golf club which was slidable in the shaft under the action of centrifugal force and against the action of the spring attached thereto. This caused the weight to engage an electric contact in the circuit of a lamp bulb mounted in the club head to cause the lamp to light up during the swinging of the club. The spring to which the battery was attached was carried by a rod which was axially adjustable within a guide sleeve in the shaft of the club. The electrical contact was mounted on an insulating plug in the shaft at a point spaced from the battery.

In the practice golf club of the above-mentioned U.S. Pat. No. 3,677,553 it was found, however, that even though some such objects could be achieved, certain adjustments were necessary. Since the power of the swing varied with different individuals, it was necessary to adjust the initial position of the battery relative to the contact, whereby a greater or lesser degree of centrifugal force was required to cause the electric contacts to be closed dependent upon the person using the club. The greater the distance between the battery and the contact, the greater the power needed to cause the electric circuit to be closed during the swinging of the club. The adjustment of the position of the battery may have to be made even when the same golfer uses the practice golf club at different times.

Another golf practice club with lights was provided by John R. Brandell, U.S. Pat. No. 3,753,564 on Aug. 21, 1973. That patented approach used two lights (non-strobing) mounted on top of the club, one toward the front and the other toward the rear. If the lights overlapped perfectly during a swing, which was neither inside-out or outside-in, then the club face alignment was presumed to be perfect. Alternatively, the lights could have also overlapped if the club face was not square for a swing which had an improper arcuate path (for example, an open face with an inside-out swing). This approach yielded information about both the swing path and club face angle, but it required the user to analyze the light patterns to get that feedback. The club face angle could only be inferred after determining which light was proximal and which light was distal, while factoring in the effect of the seen arcuate path of travel.

Still another approach was provided in U.S. Pat. No. 3,820,795 issued to David L. Taylor on Jun. 28, 1974. That patented idea was the mounting of a light source to the club hosel, which served as an indicator of the arcuate path of travel of the club. It did not, however, yield any information about the club face angle or speed.

Yet another approach to solving that problem was said to be provided in U.S. Pat. No. 5,288,080 patented Feb. 22, 1994 by D. E. Tice. In that patent, a practice golf club was provided which had strobing light sources mounted on its upper surface parallel to the club face. When swung in a dimly lit room, the strobing lights appeared as a trail of spaced images which seemed to hang briefly in the air. These "snapshots" of the club were said to make readily apparent the face angle, point of impact, speed, and arcuate path of travel of the clubhead. This was an attempt to solve the problem of avoiding the blur of a swinging golf club by attempting to illuminate the blur of a swinging golf club. This was said to make the arcuate path of travel of the club more visible, to try to inject some information into that blur so that the user could extrapolate and make an inference about the club face angle.

Still another attempted solution to such problem resided in a system that let the golfer see his swing as he was actually making it. Yet many of those monitoring systems of a golfer's swing were very complicated and sophisticated. They made tapes of the swing through video cameras, which could only be viewed after the swing was made. The tapes were able to be replayed because they were a permanent record. Such devices had draw backs due to the fact the swing was finished and the golfer could not stop to view his actions during execution of the same. There was thus a lag time between the actual swing and the play back of the swing.

Accordingly, an alleged improvement was provided in U.S. Pat. No. 5,297,796 patented Mar. 29, 1994 by J. R. Peterson. In that patent, a visual monitoring system was provided for a golfer in order to enable him simultaneously to watch his golf swing while his swing was being made. The system includes one or more video cameras and a video monitoring screen mounted below a transparent surface where the swing was being made with a golf club for viewing the swing without distorting the head of the golfer during the golf swing. Obviously, this was too expensive and complicated a system.

SUMMARY OF THE INVENTION

Aims of the Invention

Accordingly, an object of the present invention is to provide a teaching aid golf club which is universally usable by various golfers without adjustment.

Another object of this invention is to provide such a golf club where the golfer can see immediately from the position of a marker liquid in his golf club that the golf stroke is correct during various segments of the golf stroke.

A further object of the present invention is to provide such a golf club in which the hollow shaft portion is transparent, whereby the user can easily see from the position of a marker liquid in his golf club that the golf stroke is correct during various segments of the golf stroke.

Another object of the present invention is to provide such a golf club which contains a colored liquid used partially to fill a hollow shaft portion, whereby the level is easy to see and is pleasing to the eye.

Yet another object of the invention is to provide such a golf club which is simple in construction and is devoid of complicated mechanical, electrical or electronic gadgetry.

Statement of Invention

The present invention provides a golf swing teaching aid golf club for checking the correctness of the swing of a golfer, the teaching aid golf club comprising: a golf club having a grip portion and a head portion, and a hollow cylindrical transparent shaft interposed between the grip portion and the head portion, the hollow cylindrical transparent shaft containing a predetermined column of colored flowable liquid of low viscosity which is freely flowable unimpeded from one end of the hollow cylindrical transparent shaft adjacent to the grip portion to the other end thereof adjacent to the head portion, whereby, before the golf swing, the liquid adopts a position within the hollow cylindrical transparent shaft at a selected marker line to provide an easily visible correct attitude of the golf club when the golfer addresses the golf ball and whereby, under the influence of centrifugal force during the golf stroke, the liquid thereby adopts different locations within the hollow cylindrical transparent shaft during the golf swing, at selected marker lines, so as to provide the golfer with an easily visible indicator of the correct attitude of back swing, at golf ball impact and of followthrough.

Other Features of the Invention

By one additional feature of the invention, the hollow shaft comprises a cylinder coaxially-disposed around a shaft of a golf club, and having liquid seals at both ends of the coaxially-disposed cylinder where it meets the shaft.

By another feature of the invention the hollow shaft comprises a hollow cylinder joining a golf club head to a golf club grip.

By still another feature of the invention the colored liquid is colored water.

Distinctions Over the Prior Art

The present invention differs from the prior art of which the inventor is aware in that: it does not provide any structure in which the golf club includes multiple valves, wherein flowable material distribution is variable; it does not provide a structure in which a practice golf club is provided with variable head and/or handle weight which exercises the proper muscles, which will improve the golfers' swing; it does not provide a structure in which a golf club handle is provided. Predetermined, horizontal, equally-spaced markings are located, with these markings representing different weight distribution.

The present invention differs from the golf teaching aid of U.S. Pat. No. 3,677,553 in that it does not rely upon any mechanical cooperation to provide a visual indication of the golf stroke.

It differs from the liquid-filled golf club of U.S. Pat. No. 5,082,279 since it does not have any structure providing variable weight distribution by employing multiple valves which are located at predetermined positions along the handle section of the golf club, whereby the amount of flowable material allowed to flow to the golf club head, or sections of the golf club handle is regulated and captured by the multiple valves.

It differs from the golf club of U.S. Pat. No. 5,316,300 since it does not include a relatively incompressible high viscosity fluid material in a selected portion of the hollow shaft, (which is made hollow in form to provide a high strength to weight ratio) to avoid the tendency to distort by bending or twisting during the golf stroke, particularly on impact with the ball, thus resulting in a torquing action which can result in an error in the stroke.

It differs from the Varley U.K. Patent Application GB 2,167,966A in that it does not provide a structure for a golf club in which its total weight can be set according to individual needs so as to be able to influence the position of the center of gravity with the use of means integrated with the club, so that extreme head weights can be attainable.

It differs from U.S. Pat. Nos. 3,649,028 and 3,649,029 in that it does not include luminescent colored strips at the top of the golf club.

It differs from U.S. Pat. Nos. 3,753,956; 3,820,795; and 5,288,080 in that it does not include either no-strobe or strobe lights associated with the golf club head.

It differs from U.S. Pat. No. 5,297,796 in that it does not include the use of any video camera systems.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENTS

Figure 1:
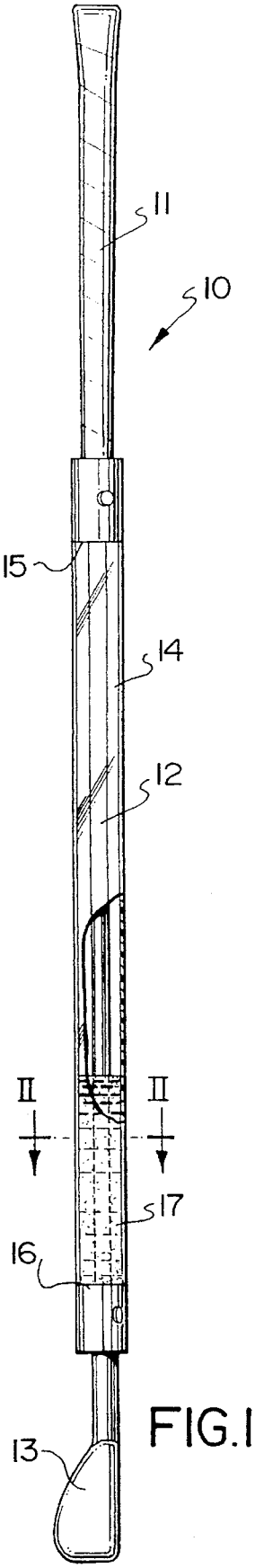
FIG. 1 is a side, elevational view of the teaching aid golf club of one embodiment of the present invention.
Figure 2:
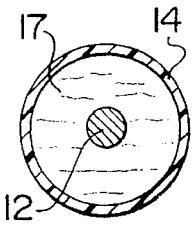
FIG. 2 is a cross-section along the line II—II of FIG. 1 showing critical features of the present invention.

Description of FIGS. 1 and 2

As seen in FIGS. 1 and 2, the teaching aid golf club 10 includes a conventional grip 11, a conventional shaft 12 and a conventional head 13. To provide the present invention a transparent material, i.e., acrylic plastic, nylon, etc., cylinder 14 is secured concentrically around the shaft to be sealed at seals 15,16 to the grip 11 and club 12, respectively. Before sealing, colored liquid of low viscosity 17, e.g., water containing red dye #1, is placed inside the cylinder. Thus, as the golf club 10 is swung the colored liquid is free to move unimpeded along the entire length of the transparent cylinder 14.

Figure 3:
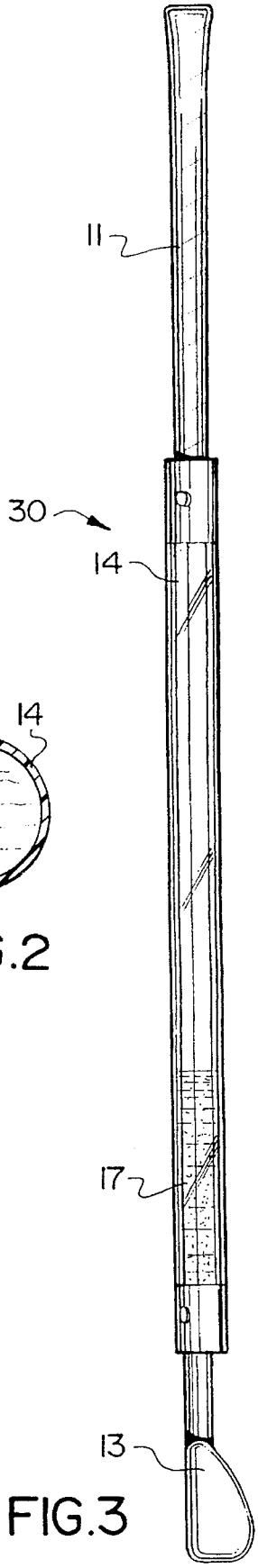
FIG. 3 is a side, longitudinal view of the teaching aid golf club of another embodiment of this invention.

Description of FIG. 3

In a variation 30 thereof shown in FIG. 3 the conventional shaft 12 is omitted, and the cylinder 14 is directly attached to the grip 11 and the club 13.

In another variation (not shown) the present invention may be molded as a one-piece object having a handle, a transparent cylinder and a head. Thus where there is references to a golf club having a grip, a club and a hollow shaft, it is intended to embrace unitary one-piece molded golf clubs and individual components unitarily held together.

DESCRIPTION OF OPERATION OF THE PREFERRED EMBODIMENTS

Figure 4:
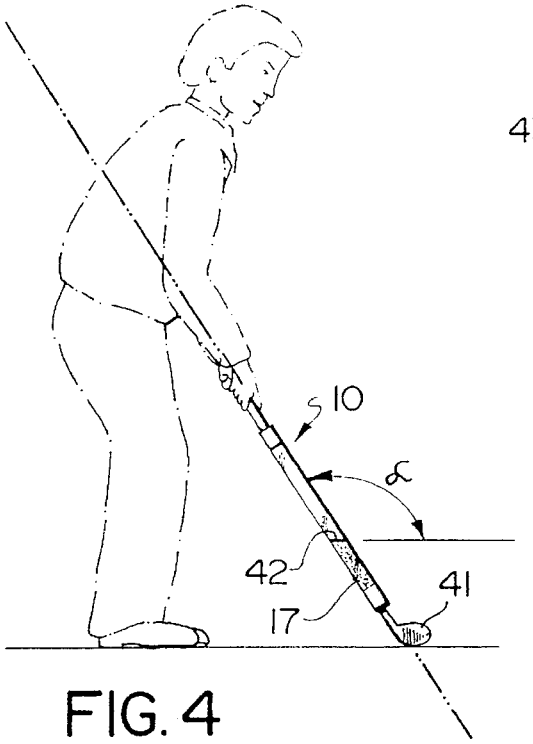
FIGS. 4 to 7 depict various stages of the golf swing showing how the teaching aid golf club of the present invention is used to teach a golf pupil.

The operation of the invention in teaching a pupil the proper golf swing is shown in FIGS. 4 to 7 in the following terms:

As seen in FIG. 4, the proper angle 8 for addressing the golf ball 41 is shown. This angle is marked by a line 42 on the transparent cylinder 14 so that, at all time of addressing the ball, the golfer inclines his golf club 10 at the proper angle.

Figure 5:
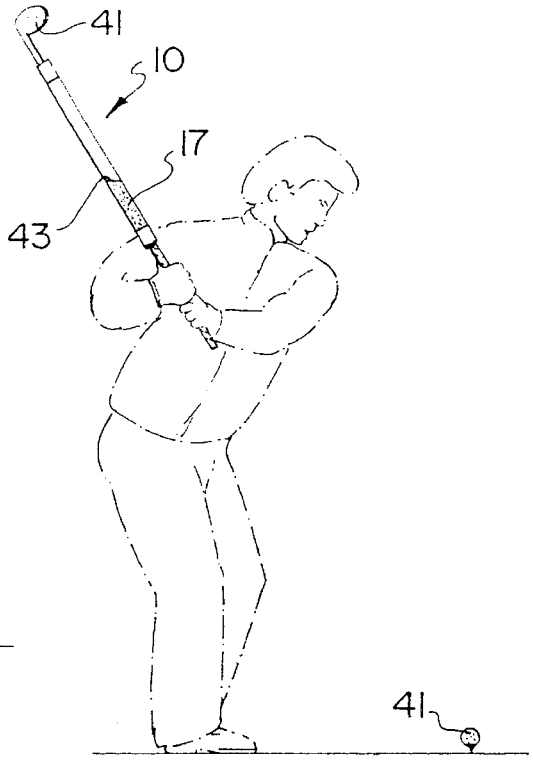

FIG. 5 shows the proper back swing at the limit of the back swing. The golfer can determine if his back swing is correct by merely glancing over his shoulder to see that the marker liquid 17 is at a second marker line 43, adjacent his hand.

Figure 6:
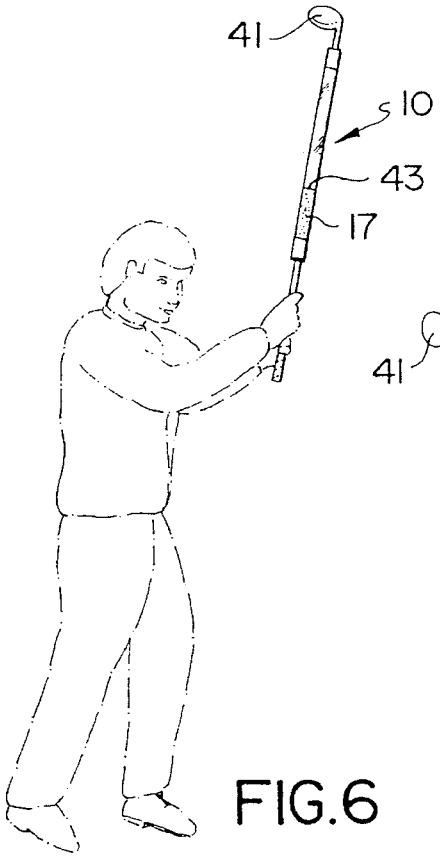

FIG. 6 shows the attitude of the golf club 10 between the time of impact of the golf club with the golf ball 41. Again, it is seen that marker liquid 17 is at the second marker line 43 adjacent his hand.

Figure 7:
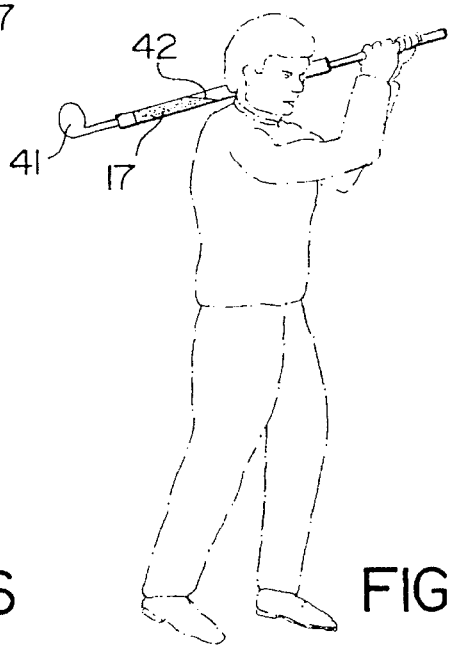

FIG. 7 shows the attitude of the golf club at its follow through position. It is noted that the position of the marker liquid is again at its first marker line 42.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A golf swing teaching aid golf club for checking correctness of a swing of a golfer, said teaching aid golf club comprising: a golf club having a grip portion and a head portion, and a hollow cylindrical transparent shaft interposed between said grip portion and said head portion, said hollow cylindrical transparent shaft containing a predetermined volume of colored flowable liquid of low viscosity which is freely flowable unimpeded from one end of said hollow cylindrical transparent shaft adjacent to said grip portion to the other end thereof adjacent to said head portion, whereby before the golf swing, said liquid adopts a position within said hollow cylindrical transparent shaft at a selected marker line, to provide a visible correct attitude of the golf club when the golf ball is addressed, and whereby, under the influence of centrifugal force during the golf stroke, said liquid thereby adopts different locations within said hollow cylindrical transparent shaft during the golf swing, at selected marker lines, so as to provide a visible indicator of the correct attitude of back swing, at golf ball impact and of followthrough.

2. The golf swing teaching aid golf club of claim 1, wherein said hollow cylindrical transparent shaft comprises a cylinder which is coaxially-disposed around a golf club shaft, and having liquid seals at both ends of said coaxially-disposed cylinder where it meets said golf club shaft at said head portion and at said grip portion.

3. The golf swing teaching aid golf club of claim 1, wherein said hollow cylindrical transparent shaft comprises a hollow transparent cylinder joining said head portion to said grip portion.

4. The golf teaching aid golf club of claim 1, wherein said colored liquid is colored water.

* * * * *